US006640350B1

(12) United States Patent
Deutsch

(10) Patent No.: US 6,640,350 B1
(45) Date of Patent: Nov. 4, 2003

(54) USER INTERACTIVE MAT FOR A URINAL

(76) Inventor: Richard Deutsch, 8 Bayview Ave., Islip, NY (US) 11751

( * ) Notice: Subject to any disclaimer, the term of this patent is extended or adjusted under 35 U.S.C. 154(b) by 0 days.

(21) Appl. No.: 10/197,924

(22) Filed: Jul. 17, 2002

(51) Int. Cl.[7] ..... E03D 13/00
(52) U.S. Cl. ..... 4/309; 4/222.1
(58) Field of Search ..... 4/222.1, 309, 314, 4/661, 902; 340/604

(56) References Cited

U.S. PATENT DOCUMENTS 3,597,772 A * 8/1971 Leavitt ..... 4/222
4,103,367 A * 8/1978 Kaufer ..... 4/309 X
4,574,403 A * 3/1986 Dintemann et al. ..... 4/309
5,313,672 A 5/1994 Leudtke et al.
5,560,051 A * 10/1996 Butts ..... 4/661 X
5,604,937 A 2/1997 Davenport
5,774,905 A * 7/1998 Wagner et al. ..... 4/309

* cited by examiner

*Primary Examiner*—Robert M. Fetsuga
(74) *Attorney, Agent, or Firm*—Richard L. Miller

(57) ABSTRACT

A mat for a urinal. The mat includes a base, a disk with indicia thereon, baffles, hooks, and an optional container. The container receives either a urinal cake or an annunciator. The annunciator includes an activity switch, a signal conditioner, a counter conditioner, a sensor transducer that is exposed to the stream of urine, and an annunciator display that is visible and activates, either visibly and/or audibly, when the sensor transducer is impinged upon by the stream of urine.

20 Claims, 6 Drawing Sheets

FIG. 2
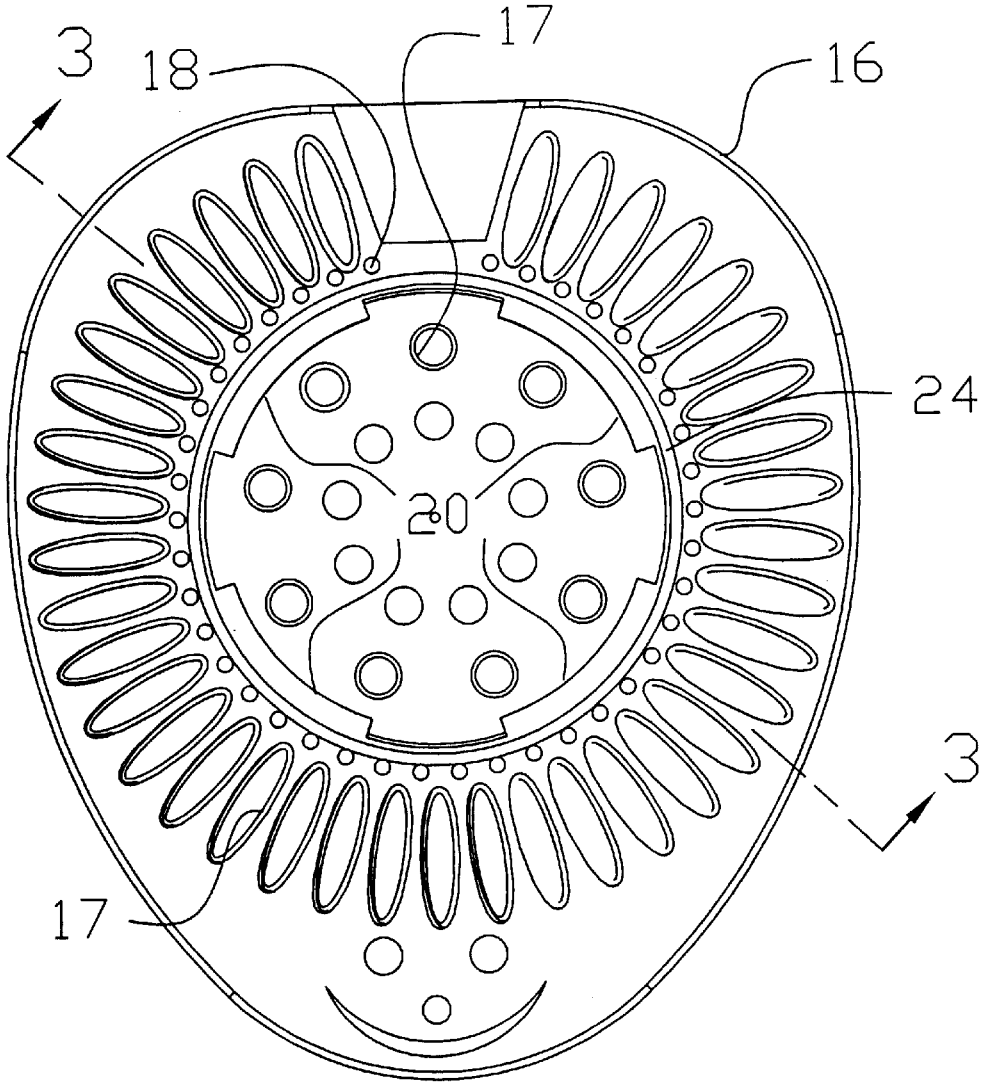
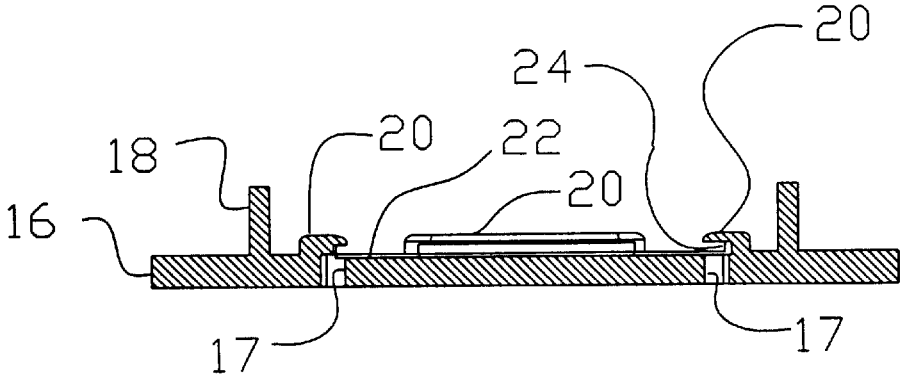
FIG. 3

FIG. 7
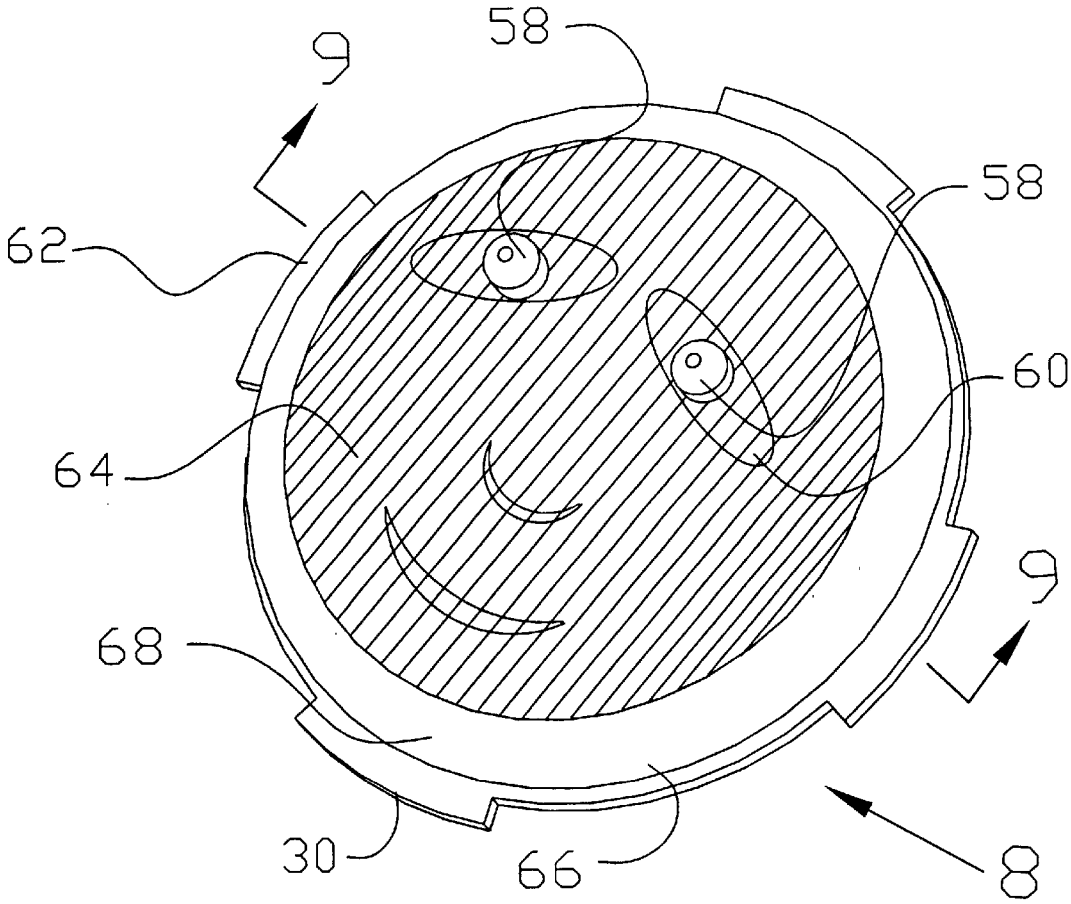
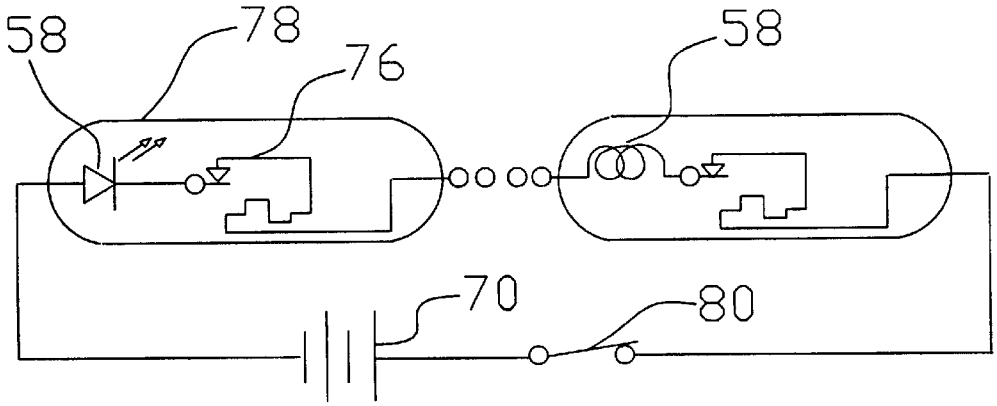
FIG. 10

USER INTERACTIVE MAT FOR A URINAL

BACKGROUND OF THE INVENTION

1. Field of the Invention

The present invention relates to a mat. More particularly, the present invention relates to a mat for a urinal.

2. Description of the Prior Arts

Numerous innovations for urinal mats have been provided in the prior art that will be described. Even though these innovations may be suitable for the specific individual purposes to which they address, however, they differ from the present invention.

A FIRST EXAMPLE, U.S. Pat. No. 5,313,672 to Luedtke et al. teaches a urinal mat provided with upstanding baffles to decelerate a stream of urine impinging thereon. The base of the mat is contoured and flexible to conform generally to the geometry within the urinal. Openings through the base are provided to permit liquids to drain through. Optionally provided are upstanding posts to receive a cake of deodorant thereon. An alternative embodiment provides a depression in the base into which deodorant may be deposited during manufacture. A flexible flange depends from an edge of the mat to engage the urinal sidewall in order to direct flush water over the mat.

A SECOND EXAMPLE, U.S. Pat. No. 5,604,937 to Davenport teaches a urinal screen assembly for disposition adjacent the drain of a urinal. The screen assembly includes feet or risers depending from the lower surface to maintain a spaced relation between at least the marginal edge of the assembly to allow liquid to flow therebetween and simultaneously prohibit the passage of unwanted solid materials. The main body portion of the screen assembly is provided with a plurality of tapered apertures which provide fluid communication therethrough and minimizes splash-back caused by an impinging stream of urine.

It is apparent that numerous innovations for urinal mats have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a mat for a urinal that avoids the disadvantages of the prior art.

ANOTHER OBJECT of the present invention is to provide a mat for a urinal that is simple and inexpensive to manufacture.

STILL ANOTHER OBJECT of the present invention is to provide a mat for a urinal that is simple to use.

BRIEFLY STATED, STILL YET ANOTHER OBJECT of the present invention is to provide a mat for. a urinal. The mat includes a base, baffles, hooks, and an optional container. The container receives either a urinal cake or an annunciator. The annunciator includes an activity switch, a signal conditioner, a counter conditioner, a sensor transducer that is exposed to the stream of urine, and an annunciator display that is visible and activates, either visibly and/or audibly, when the sensor transducer is impinged upon by the stream of urine.

The novel features which are considered characteristic of the present invention are set forth in the appended claims.

The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIG. 2 is an enlarged diagrammatic top plan view of the area generally enclosed by the dotted curve identified by arrow 2 in FIG. 1;

FIG. 3 is a diagrammatic cross sectional view taken along line 3—3 in FIG. 2;

FIG. 7 is a diagrammatic perspective view of a forth embodiment of the present invention in use;

FIG. 10 is an electrical schematic of the forth embodiment of the present invention.

LIST OF REFERENCE NUMERALS UTILIZED IN THE DRAWING

First Embodiment

Figure 1:
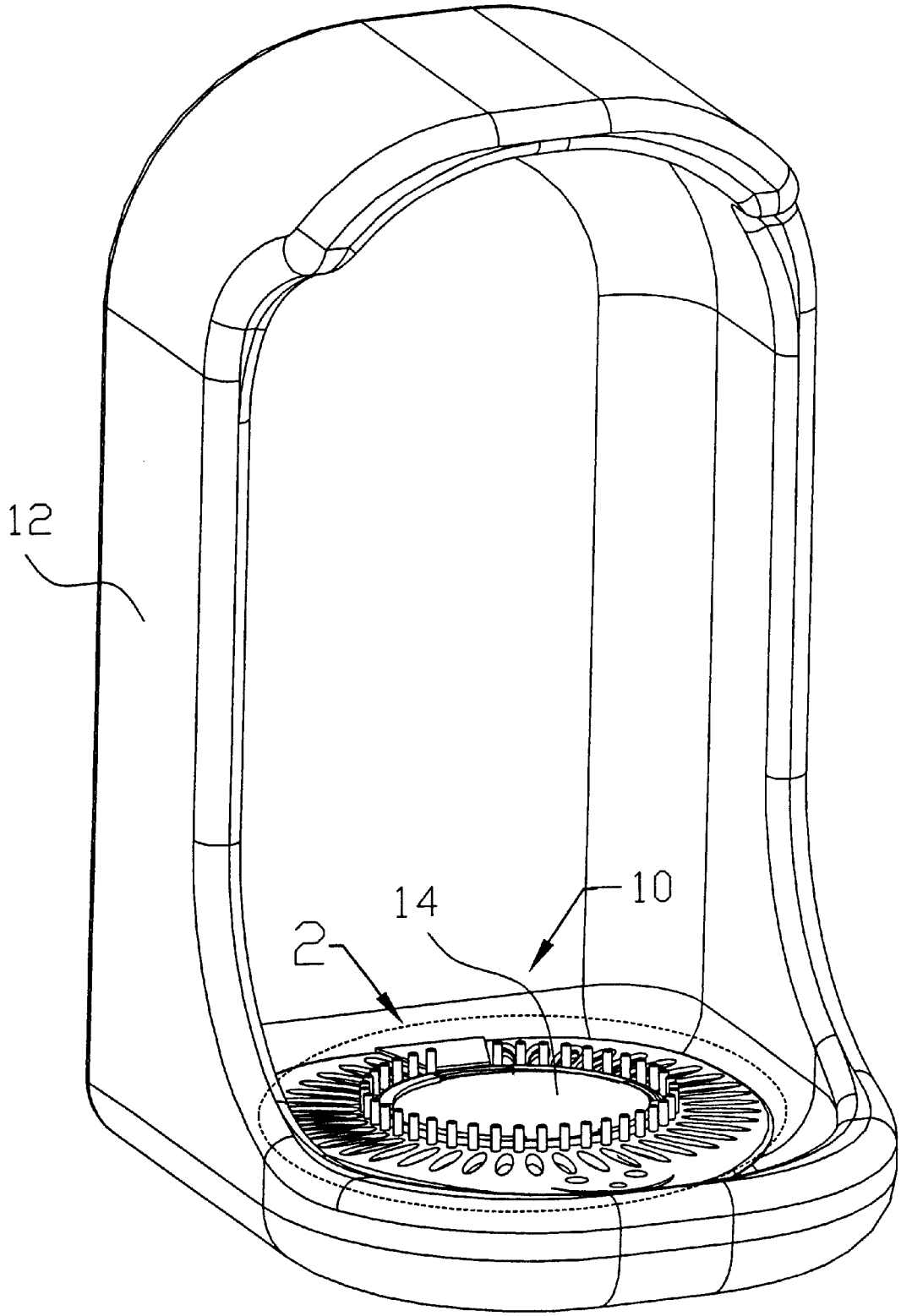
FIG. 1 is a diagrammatic perspective view of a first embodiment of the present invention in use.

10 mat of present invention for urinal 12
12 urinal
14 drain of urinal 12
16 base for overlying drain 14 of urinal 12
17 throughbores in base 16 for permitting stream of urine to drain therethrough
18 baffles for decelerating stream of urine impinging thereon
20 hooks
22 central portion of base 16
24 periphery defining central portion 22 of base 16

Second Embodiment

26 container for selectively receiving item
28 lowermost periphery of container 26
30 tabs extending intermittently, and radially outwardly, from lowermost periphery 28 of container 26
32 uppermost periphery of container 26
34 posts of container 26
36 hooks terminating posts 34 of container 26
37 urinal cake
38 disk of container 26
40 perforations through disk 38 of container 26
42 amusing indicia on disk 38 of container 26
43 optional lens

Third Embodiment

44 annunciator
46 activity switch of annunciator 44

48 signal conditioner of annunciator 44
50 counter integrator of annunciator 44
52 sensor transducer of annunciator 44 for exposing to stream of urine
53 corresponding perforation
54 annunciator display of annunciator 44 for activating when sensor transducer 52 of annunciator 44 is impinged upon by stream of urine
56 group of perforations of perforations 40 through disk 38
58 LED (Light Emitting Device)

Fourth Embodiment

60 indicia
62 tabs
64 optional lenticular lens with cooperating indicia
66 side wall
68 upper surface of container 74
70 battery
72 separate discreet flasher component
74 container
76 electronic flasher components
78 housing of the at least one LED 58
80 optional switch device

DETAILED DESCRIPTION OF THE PREFERRED EMBODIMENT

Referring now to the figures, in which like numerals indicate like parts, and particularly to FIG. 1, a first embodiment of the mat of the present invention is shown generally at 10 for a urinal 12 having a drain 14.

The configuration of the mat 10 can best be seen in FIGS. 2 and 3, and as such, will be discussed with reference thereto.

The mat 10 comprises a base 16, baffles 18, and hooks 20. The base 16 is for overlying the drain 14 of the urinal 12. The base 16 has throughbores 17. The throughbores 17 are for permitting a stream of urine to drain therethrough. The baffles 18 upstand from the base 16. The baffles 18 are for decelerating the stream of urine impinging thereon. The hooks 20 upstand from the base 16. The hooks 20 selectively engage an item, that consist of the group comprising a disk 38 and a container 26.

The base 16 is contoured and flexible for conforming generally to the urinal 12.

The base 16 has a central portion 22. The central portion 22 of the base 16 is defined by a periphery 24. The periphery 24 of the central portion 22 of the base 16 is circular-shaped.

The hooks 20 are inverted L-shaped. The hooks 20 upstand intermittently from the periphery 24 of the central portion 22 of the base 16.

The baffles 18 are slender, elongated, and pin-shaped. The baffles upstand from outboard of, and around, the hooks 20.

The throughbores 17 through the base 16 are disposed both in, and outboard of, the central portion 22 of the base 16.

Figure 4:
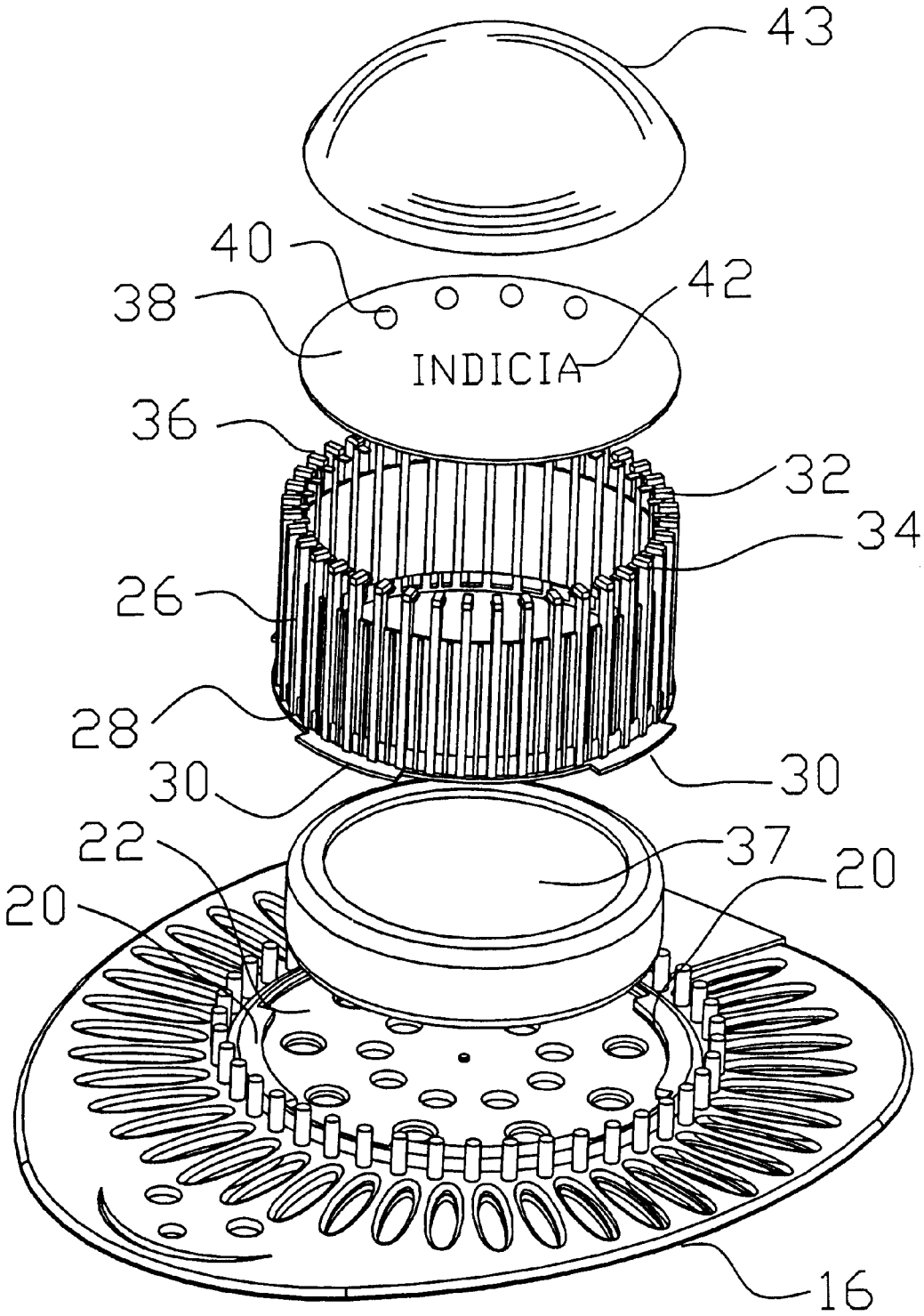
FIG. 4 is an exploded diagrammatic perspective view of a second embodiment of the present invention.

A second embodiment of the mat 10 can be seen in FIG. 4, and as such, will be discussed with reference thereto.

The mat 10 further comprises a container 26. The container 26 is selectively engaged in the hooks 20. The container 26 is for selectively receiving an item.

The container 26 has a lowermost periphery 28. The lowermost periphery 28 of the container 26 is continuous, ring-shaped, and has tabs 30. The tabs 30 of the container 26 extend intermittently, and radially outwardly, from the lowermost periphery 28 of the container 26. The tabs a 30 of the container 26 are selectively received by the hooks 20, and when engaged thereby, the container 26 is maintained in the central portion 22 of the base 16.

The container 26 further has an uppermost periphery 32. The uppermost periphery 32 of the container 26 is continuous, ring-shaped, and spaced above the lowermost periphery 28 of the container 26.

The container 26 further has posts 34. The posts 34 of the container 26 are spaced-apart from each other so as to form spaces in the container 26. The posts 34 of the container 26 extend upwardly from the lowermost periphery 28 thereof to the uppermost periphery 32, where they terminate in hooks 36. The hooks 36 of the posts 34 are inwardly radially facing.

The container 26 is for receiving a urinal cake 37.

The hooks 36 of the posts 34 receive a disk 38. The disk 38 may have optional perforations 40 therethrough and amusing indicia 42 thereon protected by an optional lens 43.

Figure 5:
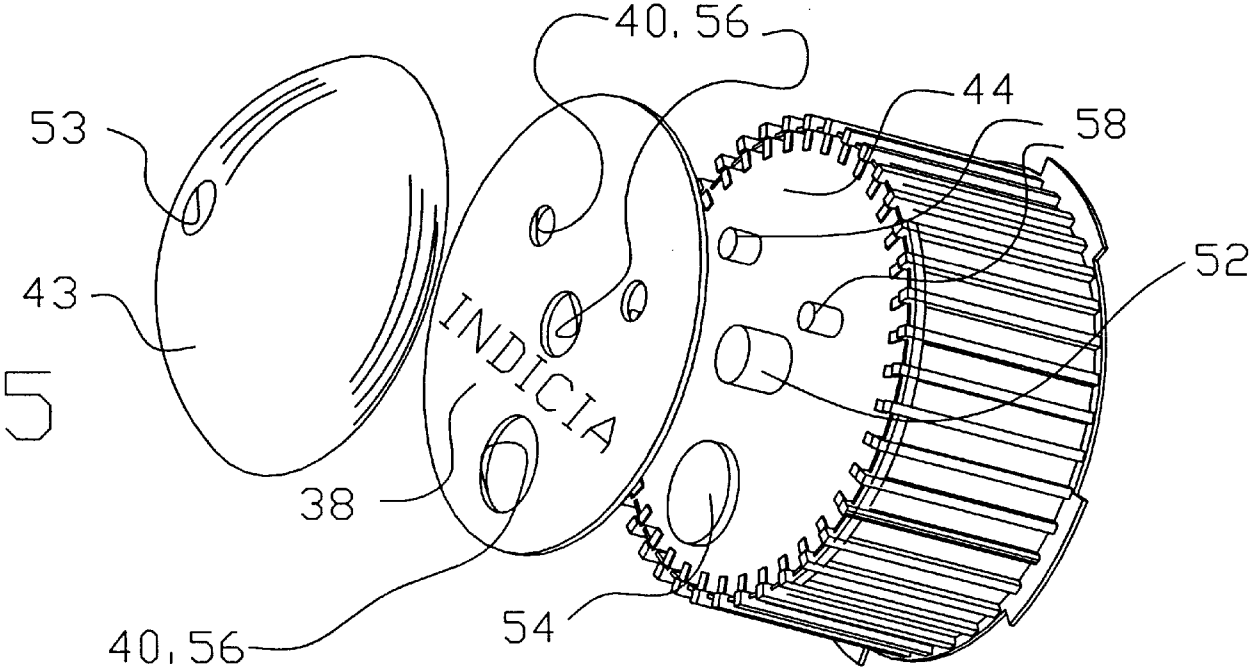
FIG. 5 is an exploded diagrammatic perspective view of a third embodiment of the present invention.
Figure 6:
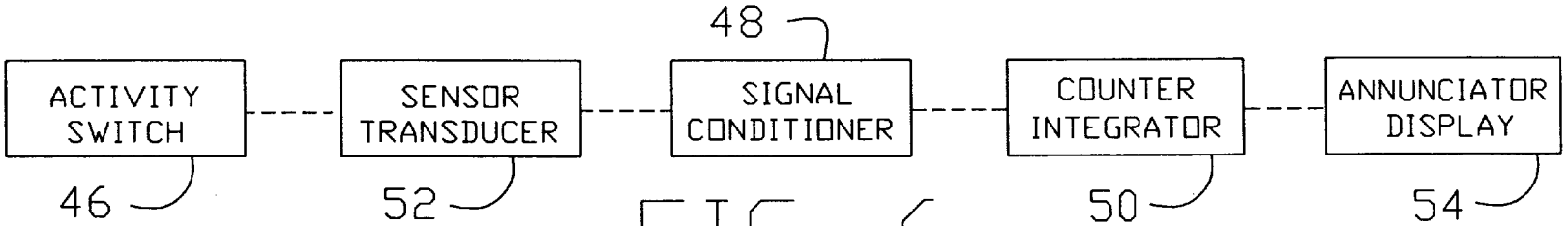
FIG. 6 is a block diagram of the circuitry of the third embodiment of the present invention shown in FIG. 5.
Figure 8:
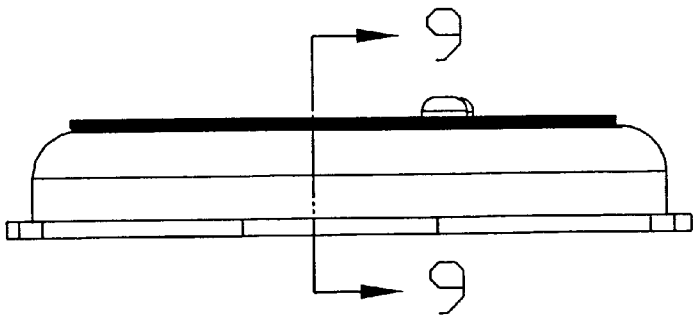
FIG. 8 is a diagrammatic elevational taken along in direction of arrow 8 in FIG. 7.
Figure 9:
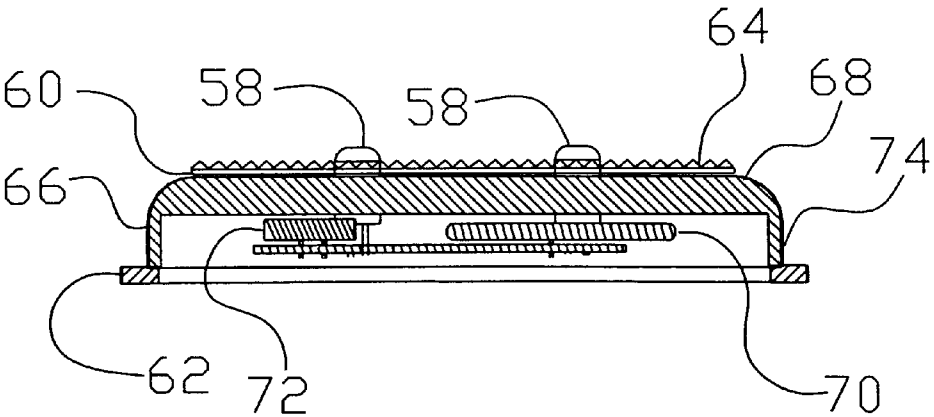
FIG. 9 is a diagrammatic cross sectional view taken along line 9—9 in FIG. 7.

A third embodiment of the mat 10 can best be understood from FIGS. 5 and 6, and as such, will be discussed with reference thereto.

The mat 10 further comprises an annunciator 44. The annunciator 44 is received in the container 26.

The annunciator 44 comprises an activity switch 46, a signal conditioner 48, and a counter integrator 50.

The annunciator 44 further comprises a sensor transducer 52. The sensor transducer 52 of the annunciator 44 is for exposing to the stream of urine.

The annunciator 44 further comprises an annunciator display 54. The annunciator display 54 of the annunciator 44 is visible and is for activating when the sensor transducer 52 is impinged upon by the stream of urine.

The perforations 40 through the disk 38 are a group of perforations 56. The group of perforations 56 through the disk 30 coincide with, so as to expose, the sensor transducer 52, the annunciator display 54, and the LEDS (Light Emitting Device) 58.

The disk 38 may be covered by an optional protective lens 43 having a corresponding perforation 53.

A fourth embodiment of the mat 10 can best be understood from FIGS. 7, 8 ,9 and 10, and as such, will be discussed with reference thereto.

The mat 10 comprises further comprises a container 74. The container 74, having a side wall 66, is selectively engaged in hooks 20 of base 16 for overlying drain 14 of urinal 12, utilizing tabs 62. The container houses a battery 70 and associated electronics. The associated electronics comprises at least one LED (Light Emitting Device) 58. electronic flasher components 76 may be optionally contained in housing 78 of the at least one LED 58 or may be installed as a separate discreet flasher component 72 so as to cause the at least one LED 58 to flash.

An upper surface 68 of container 74 will have indicia 60 thereon and may be covered by an optional lenticular lens with cooperating indicia 64. The at least one LED 58, will be placed so as to be visible through the upper surface 68 and may or may not protrude through both the upper surface 68 and the optional lenticular lens with cooperating indicia 64.

An optional switch device 80 is shown connected in a series loop with the battery 70 and the at least one LED 58 for activating and deactivating the this forth embodiment. It is to be noted that the light emitting device may be typically an incandescent lamp or a light emitting diode.

It will be understood that each of the elements described above, or two or more together, may also find a useful application in other types of constructions differing from the types described above.

While the invention has been illustrated and described as embodied in a mat for a urinal, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A user interactive mat for a urinal having a drain, comprising:

a) a base;

b) baffles; and c) hooks;

wherein said base is for overlying the drain of the urinal;

wherein said base has throughbores;

wherein said throughbores are for Permitting a stream of urine to drain therethrough;

wherein said baffles upstand from said base;

wherein said baffles are for decelerating the stream of urine impinging thereon;

wherein said hooks upstand from said base; and wherein said hooks selectively engage an item; further comprising a container;

wherein said container is selectively engaged in said hooks; and wherein said container is for selectively receiving an item, wherein said container has a lowermost periphery;

wherein said lowermost periphery of said container is continuous, ring-shaped, and has tabs;

wherein said tabs of said container extend intermittently, and radially outwardly, from said lowermost periphery of said container; and wherein said tabs of said container are selectively received by said hooks, and when encaged thereby, said container is maintained in said central portion of said base, wherein said container has an uppermost periphery; and wherein said uppermost periphery of said container is continuous, ring-shaped, and spaced above said lowermost periphery of said container, wherein said container has posts;

wherein said posts of said container are spaced-apart from each other so as to form spaces in said container;

wherein said posts of said container extend upwardly from said lowermost periphery thereof to said uppermost periphery thereof, where they terminate in hooks; and wherein said hooks of said posts are inwardly radially facing.

2. The mat as defined in claim 1, wherein said base is contoured and flexible for conforming generally to the urinal.

3. The mat as defined in claim 1, wherein said base has a central portion;

wherein said central portion of said base 16 is defined by a periphery; and wherein said periphery of said central portion of said base is circular-shaped.

4. The mat as defined in claim 3, wherein said hooks are inverted L-shaped; and wherein said hooks upstand intermittently from said periphery of said central portion of said base.

5. The mat as defined in claim 3, wherein said throughbores through said base are disposed both in, and outboard of, said central portion of said base.

6. The mat as defined in claim 1, wherein said baffles are slender;

wherein said baffles are elongated;

wherein said baffles are pin-shaped; and wherein said baffles upstand from outboard of, and around, said hooks.

7. The mat as defined in claim 1, wherein said container is for receiving a urinal cake.

8. The mat as defined in claim 1, wherein said hooks of said posts receive a disk; and wherein said disk has perforations therethrough and amusing indicia thereon.

9. The mat as defined in claim 1, further comprising an annunciator; and wherein said annunciator is received in said container.

10. The mat as defined in claim 9, wherein said annunciator comprises an activity switch, a signal conditioner, and a counter conditioner.

11. The mat as defined in claim 9, wherein said annunciator comprises a sensor transducer; and wherein said sensor transducer of said annunciator is for exposing to the stream of urine.

12. The mat as defined in claim 11, wherein said annunciator comprises an annunciator display; and wherein said annunciator display of said annunciator is visible and is for activating when said sensor transducer is impinged upon by the stream of urine.

13. The mat as defined in claim 12, wherein said perforations through said disk are a pair of perforations;

wherein said pair of perforations through said disk coincide with, so as to expose, both said sensor transducer and said annunciator display, respectively.

14. The mat as defined in claim 1, wherein said container houses a battery and at least one light emitting device.

15. The mat as defined in claim 14, further having indicia thereon covered by an optional lens with cooperating said indicia.

16. The mat as defined in claim 14, wherein a flasher is incorporated with said at least one light emitting device, so as to cause said device to flash.

17. The mat as defined in claim 14, wherein said at least one light emitting device, is visible at an upper surface of said container.

18. The mat as defined in claim 14, wherein said at least one light emitting device is an incandescent lamp.

19. The mat as defined in claim 14, wherein said at least one light emitting device is a light emitting diode.

20. The mat as defined in claim 1, further having indicia thereon covered by an optional lens with cooperating said indicia.

* * * * *